US005690212A

United States Patent [19]

Huang Hsu

[11] Patent Number: 5,690,212

[45] Date of Patent: Nov. 25, 1997

[54] BOX FOR STORING KEYS

[76] Inventor: Chin-Lien Huang Hsu, No. 38, Lane 152, Min Sheng Road, Taichung, Taiwan

[21] Appl. No.: 717,682

[22] Filed: Sep. 23, 1996

[51] Int. Cl.[6] ..... A47F 7/00

[52] U.S. Cl. ..... 206/37.8; 206/38.1; 206/493; 206/526; 16/266; 312/222; 312/248; 312/326

[58] Field of Search ..... 206/37.1, 37.4–37.8, 206/38, 38.1, 493, 526, 565, 580; 16/260, 266, DIG. 43; 312/215, 220, 222, 247, 325, 326, 248

[56] References Cited

U.S. PATENT DOCUMENTS

| | | | |
|---|---|---|---|
| 1,948,738 | 2/1934 | Thayer | 312/326 |
| 4,040,653 | 8/1977 | Takahashi | 312/222 |
| 4,326,761 | 4/1982 | Schwartz | 312/326 |
| 4,712,271 | 12/1987 | Sundermeier | 16/DIG. 43 |
| 4,864,687 | 9/1989 | Calcaterra et al. | 16/266 |
| 4,978,001 | 12/1990 | Nelson | 312/248 |
| 5,008,975 | 4/1991 | Wang et al. | 16/266 |
| 5,411,139 | 5/1995 | Victory | 206/493 |

*Primary Examiner*—Paul T. Sewell
*Assistant Examiner*—Luan K. Bui
*Attorney, Agent, or Firm*—Charles E. Baxley, Esq.

[57] ABSTRACT

A box for retaining keys includes a pair of bases secured to the upper portion and the lower portion and a pair of brackets secured to the bases. The brackets each includes a pair of parallel plates and each includes one or more shafts secured between the plates. One or more panels each includes a pair of fins secured to the upper portion and the lower portion and secured to the shafts of the brackets for allowing the panel to be rotatably secured to the shafts. The shafts each includes a neck portion of reduced size. The fins each includes an orifice for rotatably engaging with the shafts and each includes a notch for engaging with the neck portion of the shaft and for allowing the shaft to be engaged with the orifice.

3 Claims, 3 Drawing Sheets

BOX FOR STORING KEYS

BACKGROUND OF THE INVENTION

1. Field of the Invention

The present invention relates to a box, and more particularly to a box for storing keys.

2. Description of the Prior Art

Typical buildings comprise a box for storing a number of keys that are required to be suitably protected and stored. However, the typical boxes may store only few keys and comprise a weak structure. In addition, the keys may not be easily found.

The present invention has arisen to mitigate and/or obviate the afore-described disadvantages of the conventional boxes for storing keys.

SUMMARY OF THE INVENTION

The primary objective of the present invention is to provide a box for suitably storing keys therein.

In accordance with one aspect of the invention, there is provided a box for retaining keys, the box comprises a body including an upper portion and a lower portion, a pair of bases secured to the upper portion and the lower portion of the box, a pair of brackets secured to the bases respectively, the brackets each including a pair of parallel plates and each including at least one shaft secured between the plates, a first of the plates being engaged with the base and a second of the plates being spaced away from the base, at least one panel including an upper portion and a lower portion, the panel including a plurality of hooks for supporting the keys thereon, and a pair of fins secured to the upper portion and the lower portion of the panel respectively and secured to the shafts of the brackets respectively for allowing the panel to be rotatably secured to the body at the shafts.

The shafts each includes an upper portion having a neck portion of reduced size formed therein, the fins each includes an orifice for rotatably engaging with the shafts and each includes a notch communicating with the orifice for engaging with the neck portion of the shaft and for allowing the shaft to be engaged with the orifice.

The brackets each includes at least one fastening screw engaged with the first plates and the bases for securing the first plates to the bases, the second plates each includes an opening for aligning with the fastening screw and for allowing the fastening screw to be engaged with the first plates and the bases.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
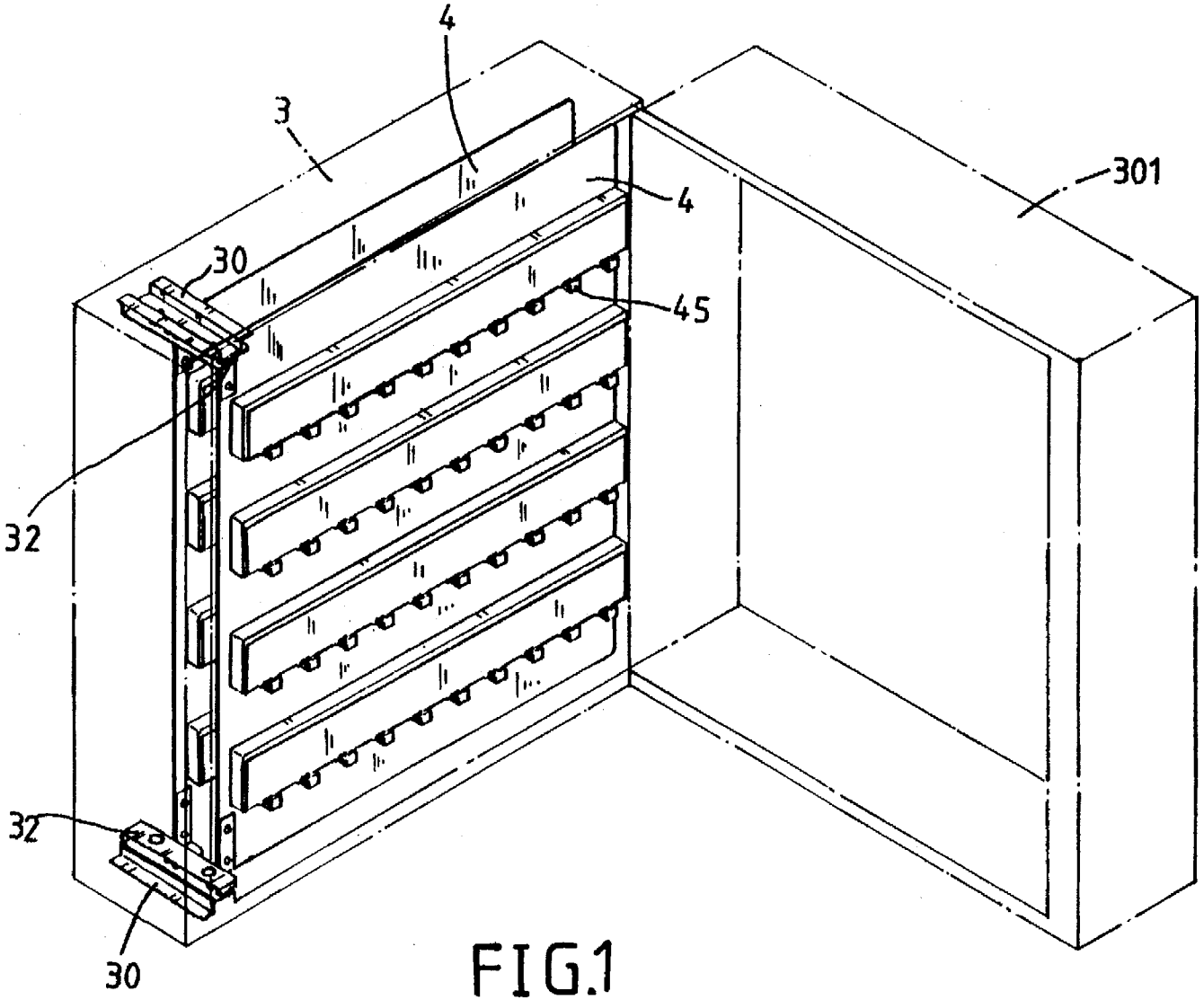
FIG. 1 is a perspective view of a box in accordance with the present invention.
Figure 2:
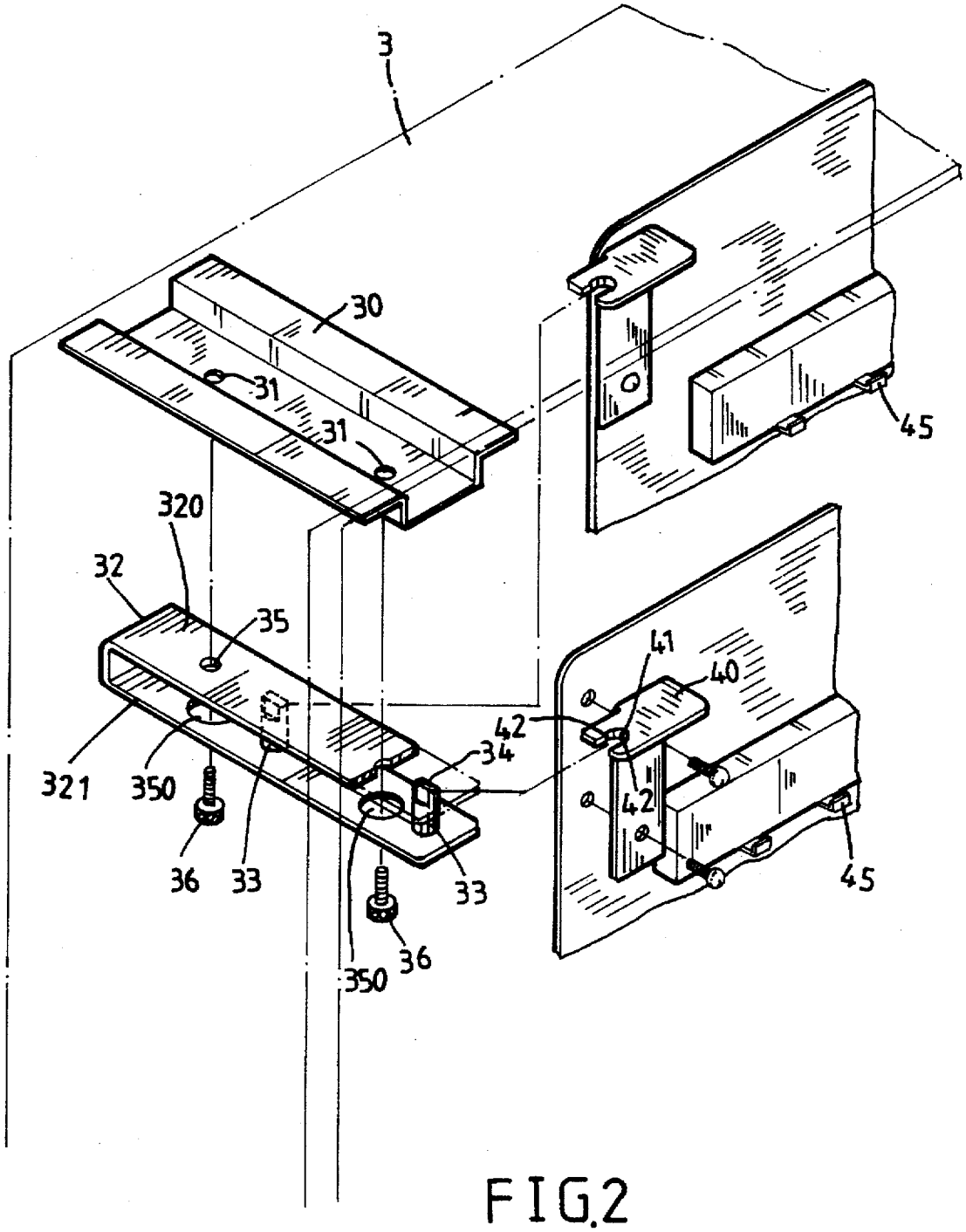
FIG. 2 is a partial exploded view of the box.
Figure 3:
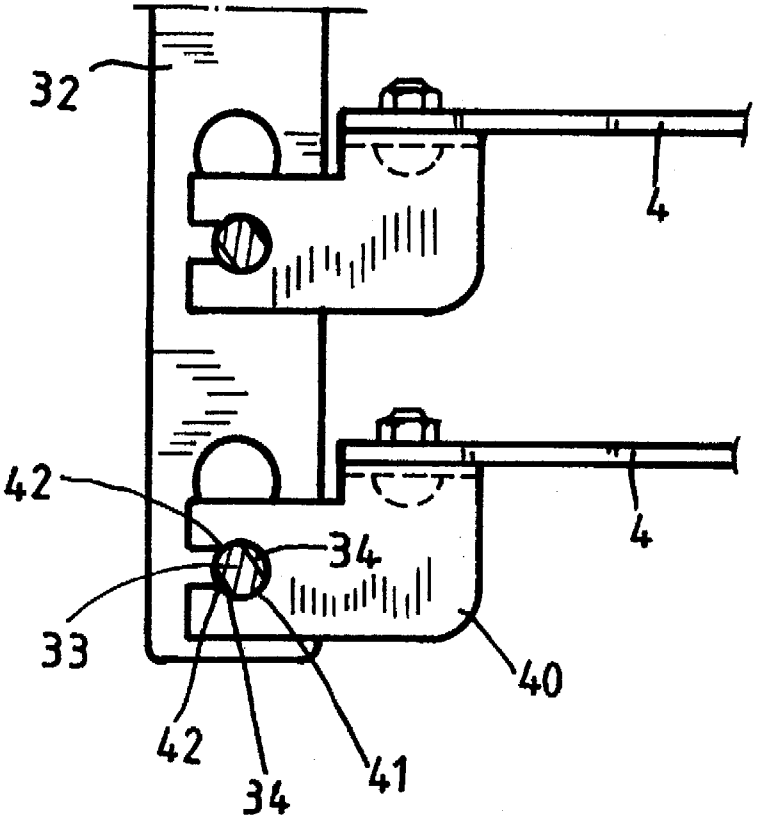

Referring to FIGS. 1 to 3, a box in accordance with the present invention comprises a body 3 and a cover 301 pivotally coupled to the body 3. The body 3 includes a pair of bases 30 secured to the upper and the lower portions of the inner portion of the body 3, best shown in FIG. 1. The bases 30 each includes two or more screw holes 31 formed therein. Two brackets 32 are secured to the bases 30 respectively and each includes a pair of parallel plates 320, 321. The plate 320 is engaged with the bracket 32 and includes two or more apertures 35 for aligning with the screw holes 31 of the bases 30 and for engaging with fastening screws 36 which may secure the brackets 32 to the bases 30. The plate 321 includes two or more openings 350 aligned with the respective screw holes 31 and apertures 35. The openings 350 have a size greater than that of the apertures 35 for allowing the fastening screws 36 to be engaged with the apertures 35 and the screw holes 31. The brackets 32 each includes one or more shafts 33 secured between the plates 320, 321. The shafts 33 each includes a neck portion 34 of reduced size formed in the upper portion.

Figure 4:
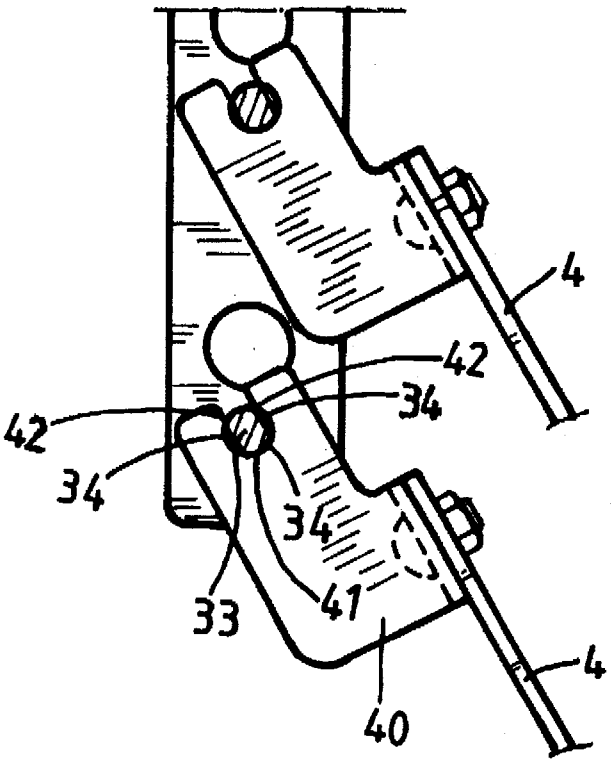
FIGS. 3 and 4 are schematic views illustrating the operation of the box.

One or more panels 4 each includes a number of hooks 45 for supporting keys thereon and each includes a pair of fins 40 secured to the upper and the lower portions respectively for pivotally coupling to the shafts 33 and for allowing the panels 4 to be rotatable about the respective shafts 33. The fins 40 each includes an orifice 41 for engaging with the respective shaft 33 and includes a notch 42 communicating with the orifice 41 for engaging with the neck portion 34 of the shaft 33 and for allowing the shaft 33 to be engaged with the orifice 41. The fins 40 may be moved to the bottom portion of the shafts 33 by the weight of the panel 4 such that the notch 42 is disengaged from the neck portion 34 when the panel 4 is released and is not supported by the user. The notch 42 includes a size smaller than that of the orifice 41 such that the shafts 33 can be stably retained in the orifices 41 and will not be disengaged from the fins 40. The panel 4 may thus be rotatably coupled to the brackets 32 at the shafts 33, best shown in FIGS. 3 and 4.

It is to be noted that the shafts 33 can be solidly and stably secured between the parallel plates 320, 321 of the brackets 32 such that the panels 4 may be stably secured to the brackets 32. In addition, when the brackets 32 are solidly secured to the bases 30, the panels 4 may be easily secured to the brackets 32 by engaging the orifices 41 with the shafts 33, without any further fastening members.

Accordingly, the box in accordance with the present invention includes a number of panels that may be easily and solidly secured to the brackets for allowing the panels to be rotatable about the shafts and for allowing the panels to support a number of keys.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A box for retaining keys, said box comprising:

body including an upper portion and a lower portion, a pair of bases secured to said upper portion and said lower portion of said box, a pair of brackets secured to said bases respectively, said brackets each including a pair of parallel plates and each including at least one shaft secured between said plates, a first of said plates being engaged with said base and a second of said plates being spaced away from said base, at least one panel including an upper portion and a lower portion, said panel including a plurality of hooks for supporting the keys thereon, and a pair of fins secured to said upper portion and said lower portion of said panel respectively and secured to said shafts of said brackets respectively for allowing said panel to be rotatably secured to said body at said shafts.

2. A box according to claim 1, wherein said shafts each includes an upper portion having a neck portion of reduced size formed therein, said fins each includes an orifice for rotatably engaging with said shafts and each includes a notch communicating with said orifice for engaging with said neck portion of said shalt and for allowing said shaft to be engaged with said orifice.

3. A box according to claim 1, wherein said brackets each includes at least one fastening screw engaged with said first plates and said bases for securing said first plates to said bases, said second plates each includes an opening for aligning with said fastening screw and for allowing said fastening screw to be engaged with said first plates and said bases.

* * * * *